US010626613B2

(12) United States Patent
dos Santos

(10) Patent No.: US 10,626,613 B2
(45) Date of Patent: Apr. 21, 2020

(54) SET OF COMPONENTS FOR TENDON ENCAPSULATION PROCESS IN ACTIVE ANCHOR PLATE IN PRESTRESSED CONCRETE

(71) Applicant: EVEHX Engenharia Ltda., Araucária (BR)

(72) Inventor: Jacson Polese dos Santos, Curitiba (BR)

(73) Assignee: EVEXH Engenharia Ltda., Araucaria, Parana (BR)

( * ) Notice: Subject to any disclaimer, the term of this patent is extended or adjusted under 35 U.S.C. 154(b) by 0 days.

(21) Appl. No.: 16/062,930

(22) PCT Filed: Dec. 14, 2016

(86) PCT No.: PCT/BR2016/050327
§ 371 (c)(1),
(2) Date: Jun. 15, 2018

(87) PCT Pub. No.: WO2017/100894
PCT Pub. Date: Jun. 22, 2017

(65) Prior Publication Data

US 2019/0003182 A1 Jan. 3, 2019

(30) Foreign Application Priority Data

Dec. 15, 2015 (BR) ..... 102015031377

(51) Int. Cl.
*E04C 5/12* (2006.01)

(52) U.S. Cl.
CPC ..... *E04C 5/12* (2013.01); *E04C 5/122* (2013.01); *E04C 5/125* (2013.01)

(58) Field of Classification Search
CPC . E04C 5/12; E04C 5/125; E04C 5/122; B29C 33/12; B29C 70/541; E04G 17/042; E04G 17/065
See application file for complete search history.

(56) References Cited

U.S. PATENT DOCUMENTS 2,046,497 A * 7/1936 Baker ..... B65B 13/285 140/118
2,383,864 A * 8/1945 Judkins ..... E04G 17/0658 249/217

(Continued)

FOREIGN PATENT DOCUMENTS

EP 0633369 A1 * 1/1995 ..... E04G 19/003
FR 2628777 A1 9/1989

(Continued)

OTHER PUBLICATIONS

Feb. 23, 2017—PCT/BR2016/050327 ISR and WO.

*Primary Examiner* — Adriana Figueroa
(74) *Attorney, Agent, or Firm* — Banner & Witcoff, Ltd.; Richard A. Fagin

(57) ABSTRACT

This patent refers to improvements introduced in the encapsulation technique regarding the field of tendons with anchor plates and anchor tensors, applied in the construction system of prestressed concrete in its assembly, demoulding, tensioning and final finishing with obtaining anticorrosion protection of metal parts through a set of improved components applied to the current processes and an innovative process that will ensure the seal against entry of concrete cream into the greased system during the assembly of the system, in forms prior to concreting, which will also ensure their perpendicularity to the shape and bringing advantages that will increase the speed of installation, speed of calculation response, speed in the installation of hydraulic jacks for tensioning the pull rods, ease application and perfect (Continued)

fittings in the tools, improvement of the finishing process ensuring thus effective protection for durability, reuse of components, increased safety at work and elimination of all improper process that occurs in the preparation and fixing of the anchor plate and subsequent closing and finishing.

8 Claims, 19 Drawing Sheets

(56) References Cited

U.S. PATENT DOCUMENTS 3,680,834 A * 8/1972 Holloway ..... B25F 1/00 254/25
3,685,934 A 8/1972 Huber et al.
3,744,758 A * 7/1973 Nakasone ..... B65G 7/12 254/129
4,616,458 A * 10/1986 Davis ..... E04C 5/122 52/223.13
4,799,307 A 1/1989 Reigstad et al.
4,821,474 A 4/1989 Rodriguez
5,024,032 A * 6/1991 Rodriguez ..... E04C 5/12 24/122.6
5,072,558 A 12/1991 Sorkin et al.
5,079,879 A 1/1992 Rodriguez
5,271,199 A 12/1993 Northern
5,322,264 A * 6/1994 Giambro ..... B25C 11/00 254/25
5,347,777 A * 9/1994 Sudduth ..... E04C 5/122 52/223.13
5,695,172 A * 12/1997 Hreha ..... B25C 11/00 254/18
5,839,235 A * 11/1998 Sorkin ..... E04C 5/10 52/223.13
5,897,102 A * 4/1999 Sorkin ..... E04C 5/12 249/43
5,957,429 A * 9/1999 Khachatoorian ..... B66F 15/00 254/21
6,023,894 A 2/2000 Sorkin
6,098,356 A * 8/2000 Sorkin ..... E04C 5/12 24/122.6
6,505,817 B1 * 1/2003 Witter ..... B25C 11/00 254/132
6,631,596 B1 * 10/2003 Sorkin ..... E04C 5/12 24/122.6
6,644,627 B1 * 11/2003 Forrester ..... B66F 15/00 254/131
6,684,585 B2 * 2/2004 Campbell ..... E04C 5/08 403/2
6,948,700 B2 * 9/2005 Wood ..... B66F 15/00 254/18
7,216,842 B2 * 5/2007 Watson ..... B28B 7/28 249/142
8,535,323 B2 * 9/2013 Keefer ..... A61F 2/4637 254/10.5
9,707,672 B2 * 7/2017 Belding ..... B25B 27/00
2010/0127226 A1 * 5/2010 Smith ..... B66F 15/00 254/27

FOREIGN PATENT DOCUMENTS

GB 2137254 A * 10/1984 ..... E04B 2/84
JP H1182869 A 3/1999
JP 2016153581 A * 8/2016
KR 2006078810 A * 6/2006
WO 9007410 A1 7/1990

* cited by examiner

SET OF COMPONENTS FOR TENDON ENCAPSULATION PROCESS IN ACTIVE ANCHOR PLATE IN PRESTRESSED CONCRETE

CROSS-REFERENCE TO RELATED APPLICATIONS

This application is a U.S. National Stage application under 35 U.S.C. § 371 of International Application PCT/BR2016/050327 (published as WO 2017/100894 A1), filed Dec. 14, 2016 which claims the benefit of priority to Application BR 102015031377-2, filed Dec. 15, 2015. Benefit of the filing date of each of these prior applications is hereby claimed. Each of these prior applications is hereby incorporated by reference in its entirety.

This disclosure refers to improvements introduced in the encapsulation technique regarding the field of tendons with anchor plates and anchor tensors, applied in the construction system of prestressed concrete in its assembly, demoulding, tensioning and final finishing thus obtaining anticorrosion protection of metal parts through a set of components applied to the current processes and the innovative process with execution of the greased mono-tendon prestressing system, which establishes a list of individualized and unique components with special fitting details, exclusive shapes and innovative design, where it improves its performance and enables the use of its own tools and also an assembly order with enhanced components that will ensure the seal against entry of concrete cream into the greased system during the assembly of the system, in forms prior to concreting, which will also ensure their perpendicularity to the shape, in wood or other material, maintaining this position in the concrete and a perfect finishing in the anchor niche, with the purpose of facilitating and perfecting the prestressing practice and guarantee the perfect access, fitting and adherence of the special plug, when its installation occurs after deformation of the concrete, tensioning of the tendons, approval of the prestressing by the designer and cutting of the excess cable. It also aims to identify special, unique and unprecedented designed components that have full efficiency, which can be used individually, and to improve the process of execution of the prestressing system by a greased mono-tendon shoe-shine, further bringing advantages that will increase the speed of installation, speed of calculation response, speed in the installation of hydraulic jacks for tensioning the pull rods, ease application and perfect fittings in the tools, improvement of the finishing process, ensuring thus effective protection for durability, reuse of components, increased safety at work and elimination of all improper process that occurs in the preparation and fixation of the anchor plate and subsequent closing and finishing.

Currently, there is a very expressive volume in Brazil of buildings designed with prestressed flat slabs by non-adhered greased mono-tendons. There is a worldwide search for technologies and products in order to minimize or eliminate abnormalities in the prestressed concrete structures.

Currently, there are production processes, execution processes and a set of components formed by parts and tools that consist of caps (sleeves), sealing sleeves used in conjunction with a hose piece, being a plastic that is cut in the work by improvisation, using a piece of flexible hose, made a tear in half of this piece, embedded in the anchor cable, together with the sealing sleeve, prior to the positioning of the anchor plate, and tightened with 2 or 3 moorings in annealed wire and metal anchor plate secured with annealed wires that cause corrosion spots on the surface of the prestressed concrete. Another element is the pocket form (a regular form) made of plastic, which is responsible for the molding of the anchor niche and its removal, being performed with torques, pliers or other methods that totally damages the piece. In order to carry out the encapsulation and for protection against oxidation of the active prestressing system, grate or other mortar is used, through an improvised and inadequate form of wood in a non-standardized procedure, which provides height risk, lack of ergonomics, besides being amateur, improvised and time-consuming.

Searching the Brazilian and foreign patent banks we can find the following revelations:

U.S. Pat. No. 5,347,777 entitled "Post-tensioning Anchor Plate Assembly". A post-tensioning anchor plate comprises an anchor plate and coupling elements therefor. The anchor plate is constructed with a pair of oppositely disposed protrusions, concentrically aligned cylinders or mounting members, which projects from opposite sides of a generally rectangular plate. The oppositely disposed protrusions define, on the inner surface thereof, a common tapered bore adapted to receive a cable through the same tensioning station and fastening thereof for the post-tensioning of a concrete section. The outer surface of each protrusion is also constructed with a circumferential groove adapted to receive a lip projecting into an appropriate plastic cap or tubular adapter attached thereto. In this way, the plastic cap and tubular adapter can be mounted on opposite sides of the anchor plate in sealed engagement with it to facilitate greater reliability of the anchor plate assembly post-tensioning.

U.S. Pat. No. 5,079,879 entitled "Post-tensioning Anti-Corrosion Anchor System". A method and apparatus for inhibiting the corrosion of a tendon within a post-tensioning anchor plate assembly. A tubular extension member protects the tendon and includes a foam injection opening, which is adapted for injection of foam material to inhibit tendon corrosion when it is sealed against the anchor plate. The tubular extension member further includes a circular ring disposed therealong providing a stop of water for moisture infiltration, after construction of the post-tensioning assembly. An anchor plate cap is also provided to cover the end of the post-tensioned tendon terminal. The cap is constructed with a radially extending rib extending along the inner edge to interlock engagement with the anchor plate. The round cut foam insert is provided in the cap to seal the end of the tendon.

U.S. Pat. No. 5,024,032 entitled "Post-tensioning Anchor Assembly". A post-tensioning anchor assembly comprises a tapered tubular member, cable cap and anchor plate assembly. The anchor plate is constructed for live-end/dead-end fixation on the sidewall of a concrete formation post tensioning of a sheathed cable. The plate has faces in and out constructed to receive the coupling cable or the cap of the tubular member or both. In this way, the voltage terminal board unit can be used for both out and intermediate tensor constructions. In the intermediate configuration, the tubular members are fixed to both the inside and the outer faces of the plate with the cable therethrough extending from tensioning.

U.S. Pat. No. 4,821,474 entitled "Post-tensioning Anchor Assembly". It comprises a tapered tubular member, cable cap and anchor plate assembly. The anchor plate is built for live end or dead end fixation on the sidewall of a prestressed concrete formation of a sheathed cable. The plate has faces in and out constructed to receive the coupling cable or the cap of the tubular member or both. In this way, the voltage terminal board unit can be used for both out and intermediate tensor constructions. In the intermediate configuration, the tubular members are fixed to both the inside and the outer faces of the plate with the cable therethrough extending from tensioning.

U.S. Pat. No. 4,799,307 entitled "Anchor Apparatus for a Prestressed Concrete Slab with Tendon". An anchor apparatus that provides protection against corrosion for the exposed cable in a region around where the anchor body attaches to a tendon of a prestressed and disclosed concrete slab. A conduit is secured to the inlet end of the anchor body. The other end of the conduit is glued or attached with a heat retraction tube for the tendon coating. The outlet end of the anchor body is closed either with a plug at the end of an anchor or with a second conduit and the tightening or heat tape in the tube of an intermediate strut. Fittings are provided for the insertion of corrosion-resistant lubricant into interior cavities as a second line of protection against corrosion.

Japanese Patent JPH1182869 entitled "Method of Protection against Corrosion of a Steel Anchor Body for Prestressed Concrete". Problem to be solved: to provide a method of protection against corrosion of a tensioning fastening body for a prestressed concrete steel product used for a common cable (e.g. manhole box), a bridge beam, and the like. In this method of protection against corrosion of a tensioning fastening body for a prestressed concrete steel product, a protective cap made of plastic and slightly larger than the tensioning fastening body is mounted to the tensioning fastening body to deflect a steel product to a prestressed concrete product protruding from the end of a predetermined concrete construction, and then the adhesive resin material is filled through a filler opening provided at the tip of the protective cap; the filling is stopped by confirming that the resin adhesive filled in a gap portion formed between the tensioning body and the protective cap, overflowing out of an air bleed hole provided in the base end portion of the protective cap. The protection against corrosion of the entire area of the tensioning body including the steel end part é performed by cutting the exterior air of this resin adhesive material.

French patent FR2628777 entitled "Anchors for Polyethylene-Capped Prestressing Cable for Blocking and Sealing Cable Passage Openings". Terminal fixings for high tensile cables for the maintenance of pre-compressed concrete or masonry structures, where the cables are free to move inside tubular sleeves, have a metal or trumpet-shaped liner for passage and loose metal collar externally shaped to fit the coating and to provide a radial face to support a block in which the end of the cable is secured. The liner and collar are preferably cast iron and the interface therebetween is provided with a shaped sleeve, preferably high-density polyethylene. Use/Advantage—The anchor protects the cables against constituent or leachate degradation from the masonry, and allows individual cables to be adjusted, inspected or replaced and seals the inlet to the passage through which the cable passes.

U.S. Pat. No. 6,023,894 entitled "Anchor of a Post-tensioning Anchorage System with an Improved Cap Connection". An anchor for a post-tensioning anchorage system includes an anchoring element with an end surface, a polymer encapsulation covering the anchoring element having a tubular section that extends outwardly from the end surface of the anchoring element and an improved cap having a generally tubular body with an open end and a closed end. The tubular section of the encapsulation includes a protrusion extending inwardly. The improved cap has a flange-shaped end adjacent an open end of the tubular body of the cap. This flanged end has a circumferential surface. A locking member is formed on the circumferential surface to detachably engage the protrusion such that the flanged end is received fixedly within the tubular section. A compressible seal is affixed within the polymer encapsulation and extends around the end surface. The cap has an annular surface, which extends around the open end and in compressible contact with the compressible seal when the locking member engages the protrusion.

U.S. Pat. No. 5,072,558 entitled "Post-tensioning Anchorage System". A tendon-tensioning anchor comprising a base member having a tubular section extending therefrom, a plastic encapsulation in surface-to-surface contact with the exterior of the base member and a thermal shield secured within the plastic encapsulation adjacent an end of a tubular section that extends outwardly from the base member. The plastic encapsulation opens at the end of this tubular section opposite the base member. The plastic encapsulation further comprises a tubular portion formed on the side of the base member opposite the tubular section and extends outwardly perpendicular to the base member. The heat shield is a rigid member having an outer diameter corresponding to the outer diameter of the tubular section. The heat shield has an inner surface formed to receive a portion of a sealing cap. This invention also includes an extension tube mounted to the end of the tubular portion of the plastic encapsulation. A seal is secured within the other end of the extension tube so as to create a liquid tight seal with a tendon passing therethrough.

U.S. Pat. No. 5,839,235 entitled "Protection Tube against Corrosion by a Post-Tensioning Anchorage System". A post-tensioning anchoring system including an encapsulated anchor having a trumpet-like portion extending outwardly therefrom, a tendon fixed to the encapsulated anchor and extending through the trumpet-like portion and a tubular body secured to a socket pressing engagement with the trumpet portion so as to extend out of the trumpet-like portion in axial alignment therewith. The tubular body has a seal at an end opposite the trumpet-like portion so as to form a generally liquid impermeable seal with an outer surface of the tendon. The tubular body has a notch formed on a surface outside of it. The trumpet-like portion has a surface that extends inwardly. The surface that extends inwardly engages the notch to form a fluid-tight sealing connection. A collar stretches around the tubular body on one side of the notch so as to be in close relationship with the end of the trumpet-like portion.

The foregoing disclosures have the following disadvantages, limitations and drawbacks:

1. Low quality of the seal;
2. Low efficiency in protecting the metals of the tendon at the anchor plate and locking tensor;
3. Insecurity of work due to the risk of accidents in the cutting operation;
4. Insecurity due to improvisation in works at height;
5. High cost;
6. Difficulty in obtaining materials;
7. Requirement in the extreme qualification of labor;
8. Complexity of systems and products; and
9. Largest generation of plastic waste.

"SET OF COMPONENTS FOR TENDON ENCAPSULATION PROCESS IN ACTIVE ANCHOR PLATE IN PRESTRESSED CONCRETE", the object of this invention, has been developed to overcome the drawbacks, disadvantages and limitations of existing components as well as current systems, since it adopts a improved set of components applied to current processes and the innovative process with execution of the prestressing system by a greased mono-tendon system, where an assembly order and unique pieces are established with their own unique tools, ensuring the seal against entry of concrete cream into the greased system during the assembly of the system, in forms prior to concreting, which will also ensure their perpendicularity to the form, in wood or other material, maintaining this position in the concrete and a perfect finishing in the anchor niche, further bringing advantages that will increase the speed of installation, speed of calculation response, speed in the installation of hydraulic jacks for tensioning the pull rods, which provides unique components with individualized properties that when used individually or through this innovative encapsulation process assures great ease of application and perfect fittings in the tools, improvement of the finishing process ensuring thus effective protection for durability, reuse of components, increased safety at work and elimination of all improper process that occurs in the preparation and fixation of the anchor plate and subsequent closing and finishing.

In addition, the components created and their special tools individually and principally inserted into the encapsulation system of the tendon and active anchor plate of this disclosure consist of an efficient work to assure angle, positioning, dimensioning and durability of the prestressed concrete with greased tendons, solving an ergonomic deficiency, safety at work, time of execution, quality of the final product, rework and cost to execute the works in prestressed concrete with greased mono-tendons of all the areas of Civil Engineering, serving for the assembly and launching of cables and in the process of post concreting, in the stage of preparation for cable tensioning, cutting of the cables and termination of the prestressing process with the application of the encapsulation element with a unopened plug.

Technical problems that currently exist and how this invention solved them:

1. The cap with improvised hose presents a risk of accidents in the cut of the hose besides the low quality of sealing with the use of tying with wires, solved by this invention through an optimized design of elongated cap with quality seal and using conicity in many cap positions;
2. The cap with improvised hose presents morosity and incompatibility of diameter with the tendon, solved by this invention through optimized design of elongated cap with compatible diameter and conical nozzle in the elongation, to facilitate the introduction of the same in the cover of the anchor cable;
3. The cap with improvised hose requires clamping for locking the assembly on the anchor plate to prevent undesirable tilting of the tendon at the inlet of the plate, solved by this invention-by means of plastic fasteners for fixing to the holes of the plate or with a fitting sleeve having a recess to lock by click the cap on the plate;
4. The Flat anchor plate requires clamping to secure the cap with hose and allows access to the concrete cream with loosening or tilting between the set, solved by this invention through a design of anchor plate with a protrusion in the recess for fitting of the cap with bounce;
5. The set of parts makes it difficult to prepare the prestressing, requiring a lot of labor and with risks of accidents in height work as in applications in buildings in the phase of sealing the tip of the cut tendon, solved by this invention through a set of parts with optimized design;
6. The current pocket form does not allow the use of an own tool for its removal causing difficulties of reuse of the piece made of plastic and causing environmental liabilities in addition to the risks of accidents with work at height, this is solved by this invention through an optimized design of the pocket form piece with an outer ring to fit the specially designed tool;
7. The current pocket form does not have a good seal, requiring the application of crepe tape to its bases, delaying the process and considerably increasing the use of labor, thus posing the risk of getting cream from the concrete in the anchor niche, solved by the present invention through an optimized design of the pocket form piece with appropriate fitting on the anchor plate and perfect support in the form of the concrete;
8. The formed anchor niche presents flaws and deformation, solved by this invention through use of the pocket form with optimized design proper for imperceptible and acceptable deformations and also an appropriate demoulding by a tool designed for such, which is engaged in the protrusion in outer ring;
9. The tool damages or destroys the pocket form, solved by this invention by the removing tool designed and developed specifically for removal of the anchor niche mold, also guaranteeing the work internally the slab or the concrete structure, minimizing the risks of accident and improving the working time, the final result and the physical efforts to carry out the task with the insertion of the functional ergonomics through the use of the tool;
10. Tips in annealed wire, metal inserts or nails on the face of the deformed concrete presenting corrosion and abnormalities, solved by this invention through the use of a plastic pull rod, suitable to secure the entire plate+pocket form+cap assembly in the form of the concrete, facilitating the deformation and avoiding abnormalities and corrosion;
11. The use of elements without a tool for fixing the anchor plate in the form making the work time-consuming and improvised, solved by this invention through a suitable tool for installation of the plastic pull rods;
12. Protection against corrosion at the tips of the tendon, the locking tensors and the anchor plate is not effective because it provisionally uses grease and grout aggravated by the risks of accidents at works in heights, solved by this invention through an optimized design of the self-supporting grease plug that does not require the use of grout because it has a housing dimension (niche) formed by the pocket form and its construction in mortar or concrete manufactured in a controlled way that guarantees the protection of the metals contained in the niche;
13. The inexistence of a tool to execute the closure of the anchor niche, solved by this invention through the use of its own tool to install the plug, minimizing the risks of work accidents, allowing ergonomic and practical operation; and
14. The improvised encapsulation is archaic, solved through the use of its own plug in self-performance concrete and grease chamber housed in the plug that is adhered through the soak with adhesive, epoxy, polyurethane or any other suitable, causing the rupture of the grease chamber by penetrating the same through the tip of the tendon.

For a better understanding of this invention, attached hereto are the following figures.

Figure 1:
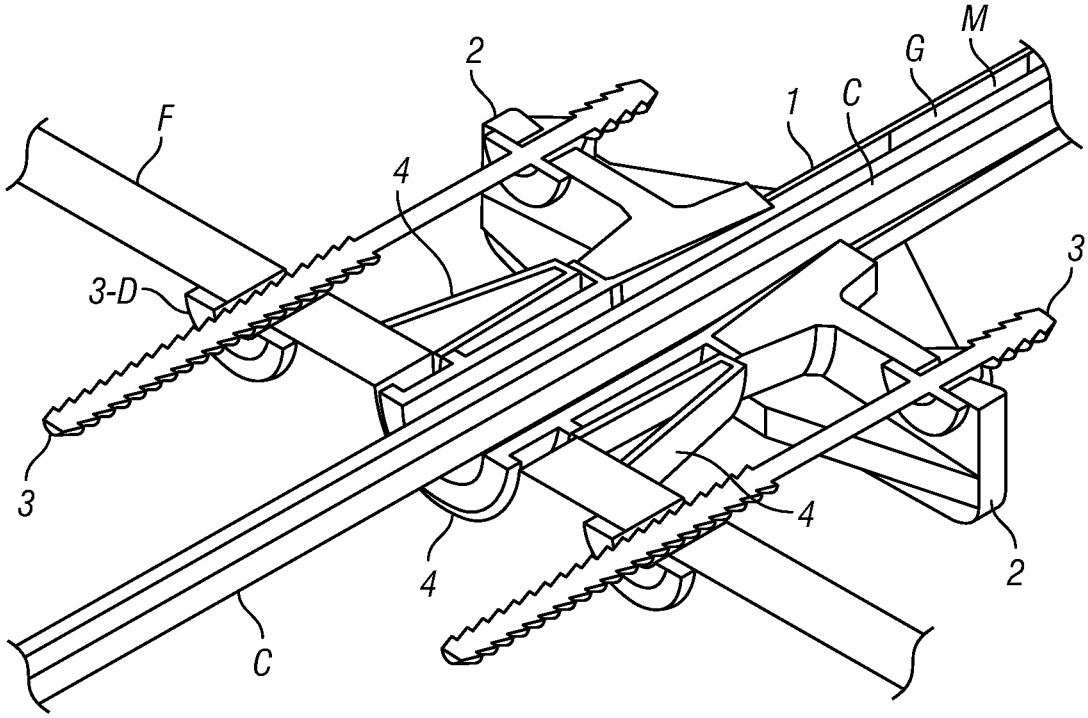
FIG. 1 shows the perspective view of the tendon covered with a hose with cap, anchor plate, pocket form, pull rod and form, identifying the individual details of each component and their formation together, allowing the visualization of the fittings and sequence assembled into the set of components of this invention placed before concreting.
Figure 2:
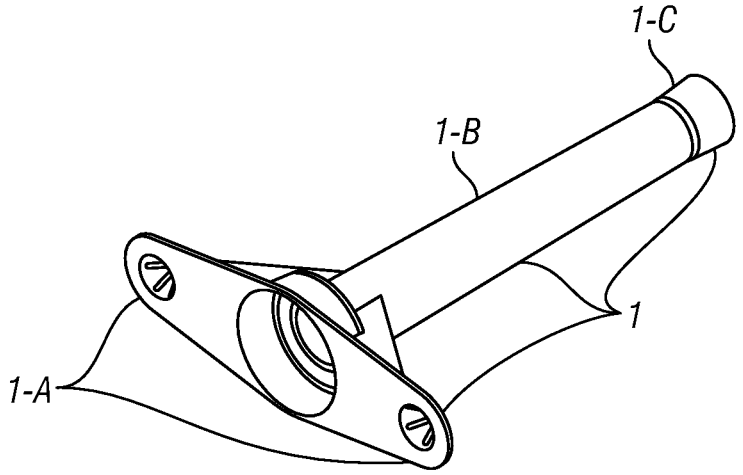
FIG. 2 shows the front perspective view of the flanged cap, one of the individual components of the set of components of this invention.
Figure 3:
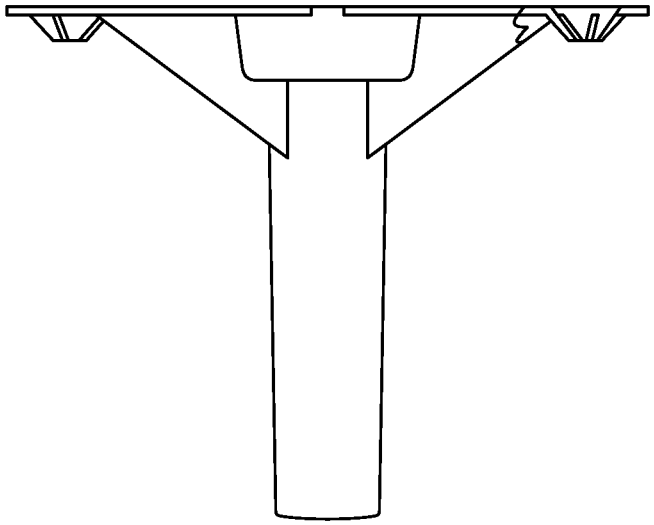
FIG. 3 shows the top view of the flanged cap, one of the individual components of the set of components of this invention.
Figure 4:
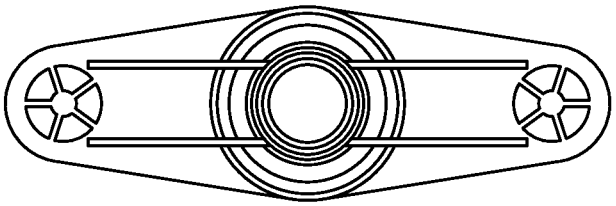
FIG. 4 shows the rear view of (1-C) to (1-A) of the flanged cap, one of the individual components of the set of components of this invention.
Figure 5:
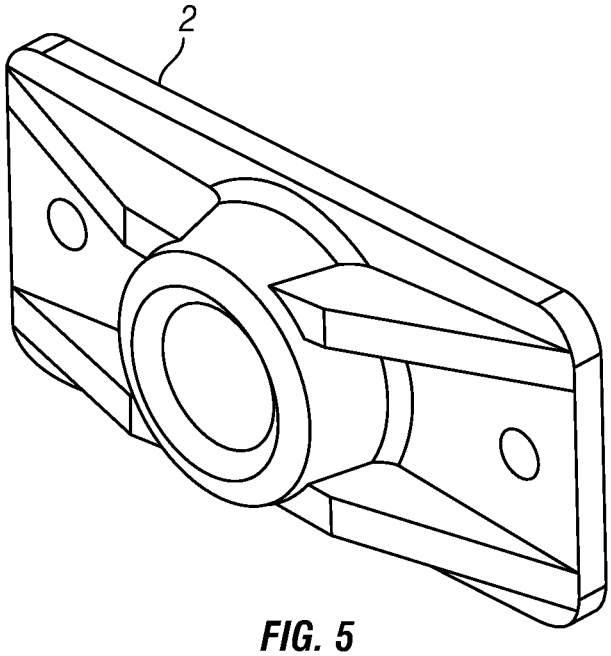
FIG. 5 shows the front view of the improved anchor plate, one of the individual components of the set of components of this invention.
Figure 6:
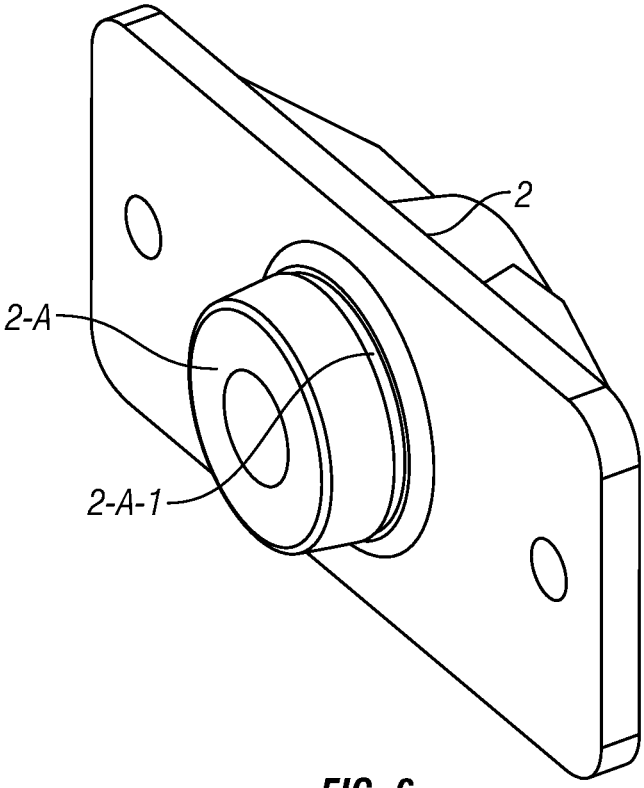
FIG. 6 shows the rear perspective view of the improved anchor plate, one of the individual components of the set of components of this invention.
Figure 7:
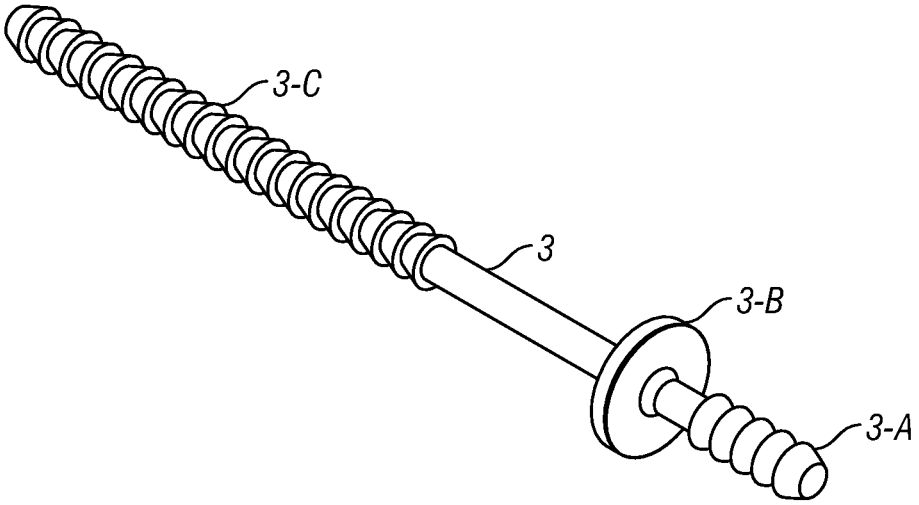
FIG. 7 shows the front perspective view of the pull rod, one of the individual components of the set of components of this invention.
Figure 8:
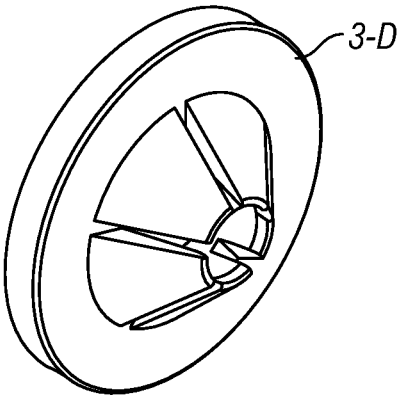
FIG. 8 shows the front perspective view of the pull rod lock, one of the individual components of the set of components of this invention.
Figure 9:
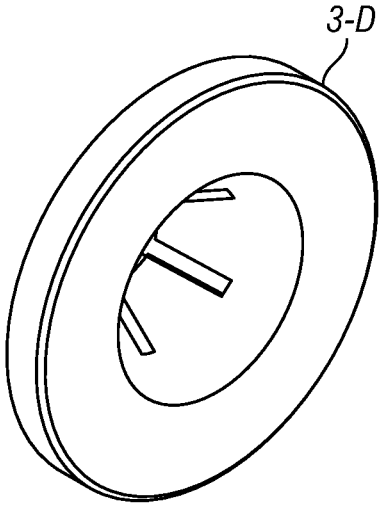
FIG. 9 shows the rear perspective view of the pull rod lock, one of the individual components of the set of components of this invention.
Figure 10:
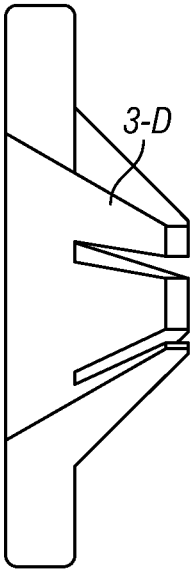
FIG. 10 shows the longitudinal cross-sectional view of the pull rod lock, one of the individual components of the set of components of this invention.
Figure 11:
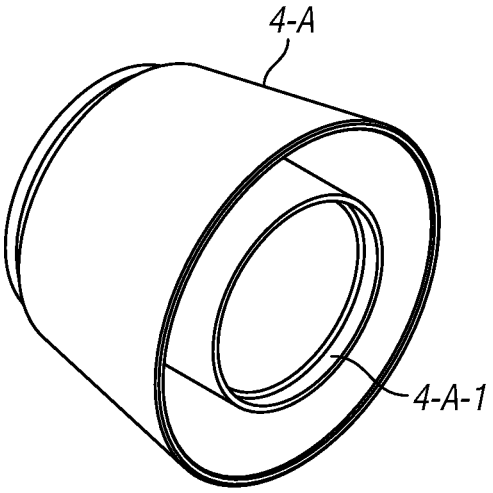
FIG. 11 shows the front view of the outer cover (anchor niche molding skirt) of the pocket form, one of the individual components of the set of components of this invention.
Figure 12:
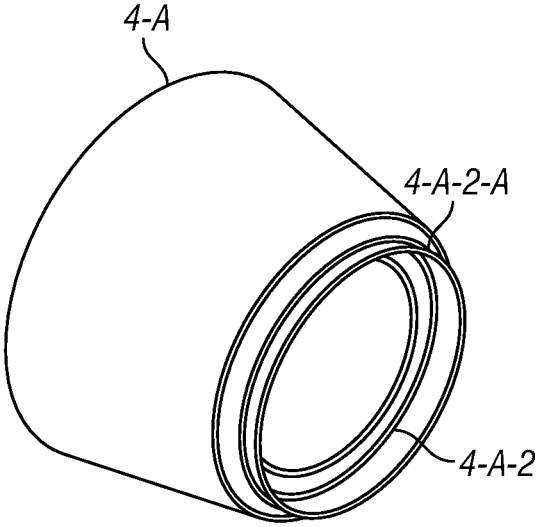
FIG. 12 shows the rear perspective view of the outer cover (anchor niche molding skirt) of the pocket form, one of the individual components of the set of components of this invention.
Figure 13:
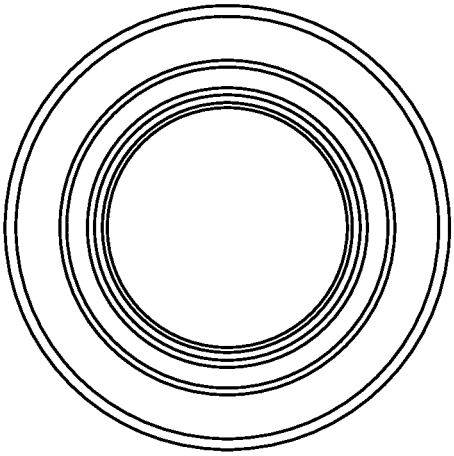
FIG. 13 shows the top view from (4-A-1) to (4-A-2) of the outer cover (anchor niche molding skirt) of the pocket form, one of the individual components of the set of components of this invention.
Figure 14:
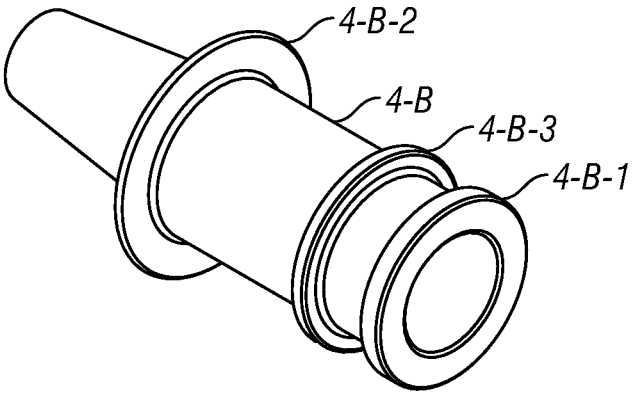
FIG. 14 shows the front view of the pocket form core (guide), one of the individual components of the set of components of this invention.
Figure 15:
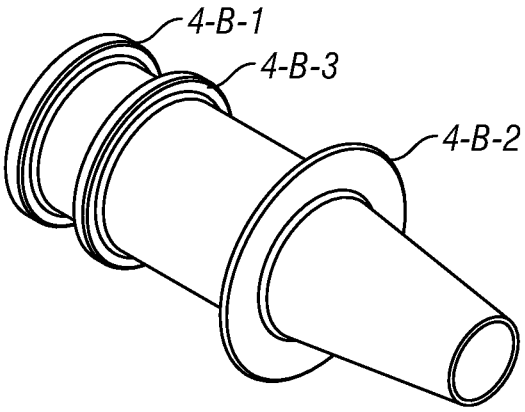
FIG. 15 shows the rear perspective view of the pocket form core (guide), one of the individual components of the set of components of this invention.
Figure 16:
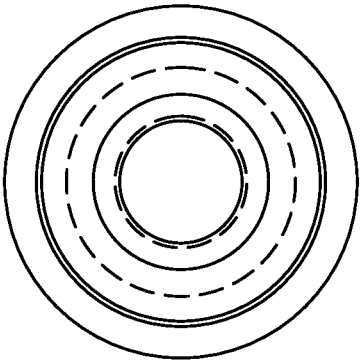
FIG. 16 shows the rear view of the core (guide) from (4-B-1) to (4-B-2) of the pocket form, one of the individual components of the set of components of this invention.
Figure 17:
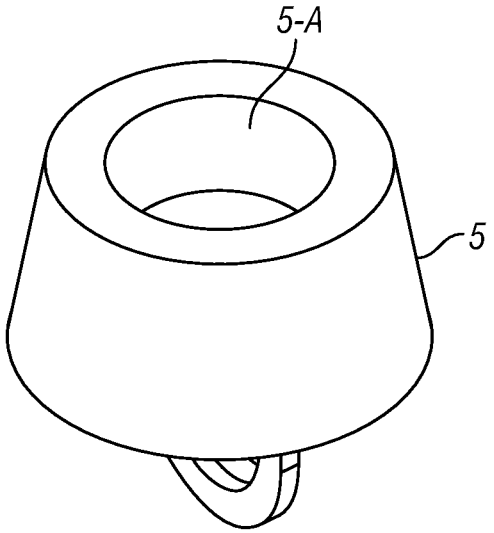
FIG. 17 shows the side perspective of the plug, one of the individual components of the set of components of this invention.
Figure 18:
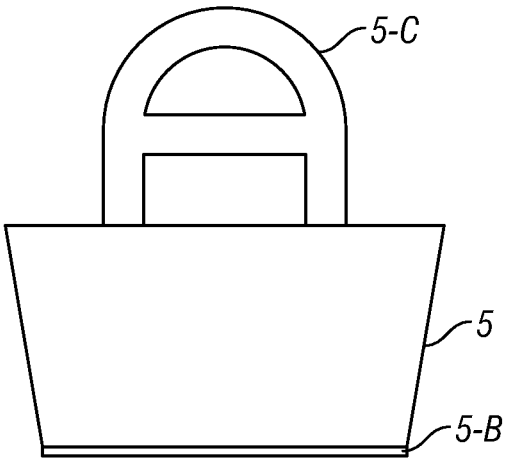
FIG. 18 shows the side view of the plug, one of the individual components of the improved set of components of this invention.
Figure 19:
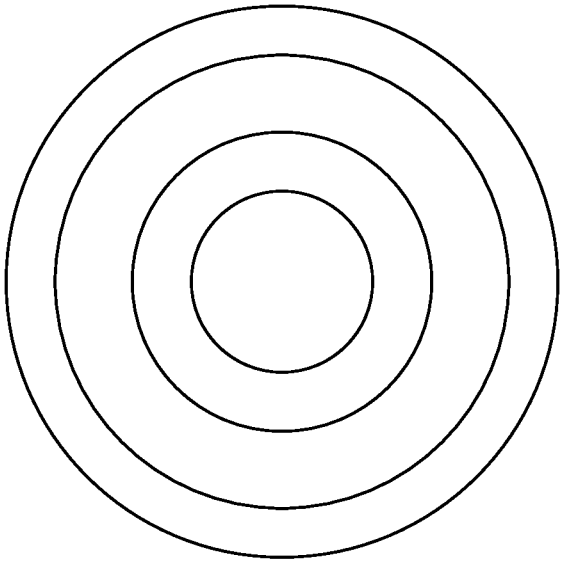
FIG. 19 shows the bottom view of the plug, one of the individual components of the set of components of this invention.

The set of components of this invention used in conventional encapsulation processes or in the process claimed herein is formed by the following items:

Flanged cap (1) made of plastic or other suitable material, having elongated shape with an anterior sleeve with truncated-cone shape fixing tabs (1-A) (with perfect contact between the cap and anchor plate, thus allowing the use of conventional anchor plates) and cylindrical-shaped central body (1-B) and truncated-cone-shaped posterior end (1-C) (to facilitate penetration of the often-shredded tendon) attachable to the anchor plate (2), fastened by the double pull rod fastener (3) and attachable to the set of tendon (C), grease (G) and hose (M);

Metal anchor plate (2) with tapered shape posterior bounce (2-A) with a with click type female plug (2-A) (for a perfect coupling of the fitting cap with the anchor plate, avoiding the concrete cream penetration on the tendon) and fastened by the double pull rod fasteners (3) engageable in the flanged cap (1) and by the mountable pocket form (4);

Double pull rod fastener (3) having predominantly cylindrical shape, with the front equipped with locking rings (3-A) and fixed washer (3-B) and the back equipped with locking rings (3-C) in plastic or other suitable material and with lock (3-D) of ringed and truncated-cone shape with cuts forming locking wedges (to prevent wire tips that can generate corrosion on the surface of prestressed concrete) and fasteners of the cap set (1) and anchor plate (2) in the form (F);

Mountable pocket form (4) in plastic or other suitable material with two fitting parts with truncated-cone-shaped hollow outer cover (4-A) with trapezoidal-shaped internal guides (4-A-1) and ring-shaped stopper (4-A-2) with sealing skirt (4-A-2-A) having cylindrical and conical shape (improving the system lock and preventing concrete cream to penetrate the system between the pocket form and anchor plate) and core (4-B) having a hollow cylindrical shape with a removing ring (4-B-1) (protrusion with a fitting that adapts itself to a tool that will remove it from the concrete), support ring (4-B-2) having the shape of a ring and a fitting bounce (4-B-3) also in the shape of ring (the use of the mountable pocket form is due to the fact that its manufacture is simpler and allows the interchangeability of the outer cover favoring the environment and being able to be replaced by a monobloc pocket form of same design and functionality of the object required in this invention) engageable in the anchor plate (2) and passing through the form (F); and Plug (5) in concrete or mortar, having truncated-cone shape, closed on one side and filled with antioxidant grease (5-A) (the same as the tendon), with sealing seal (5-B) adhered and closing the open side (which protects the grease in an internal space of the plug, same space that breaches the tip of the tendon at the time of its application) and handle (5-C) having the shape of an "A" in plastic or other suitable material fixed in the closed and fitting side adhered to the anchor niche (NF). See FIGS. 2 to 19.

Figure 20:
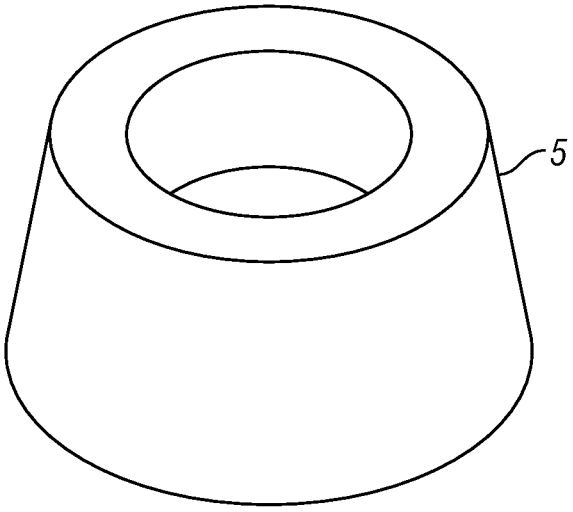
FIG. 20 shows the side perspective of the plug without a handle, one of the individual components of the set of components of this invention.

Alternatively, one could adopt the plug (5) without the handle (5-C). See FIG. 20.

Figure 21:
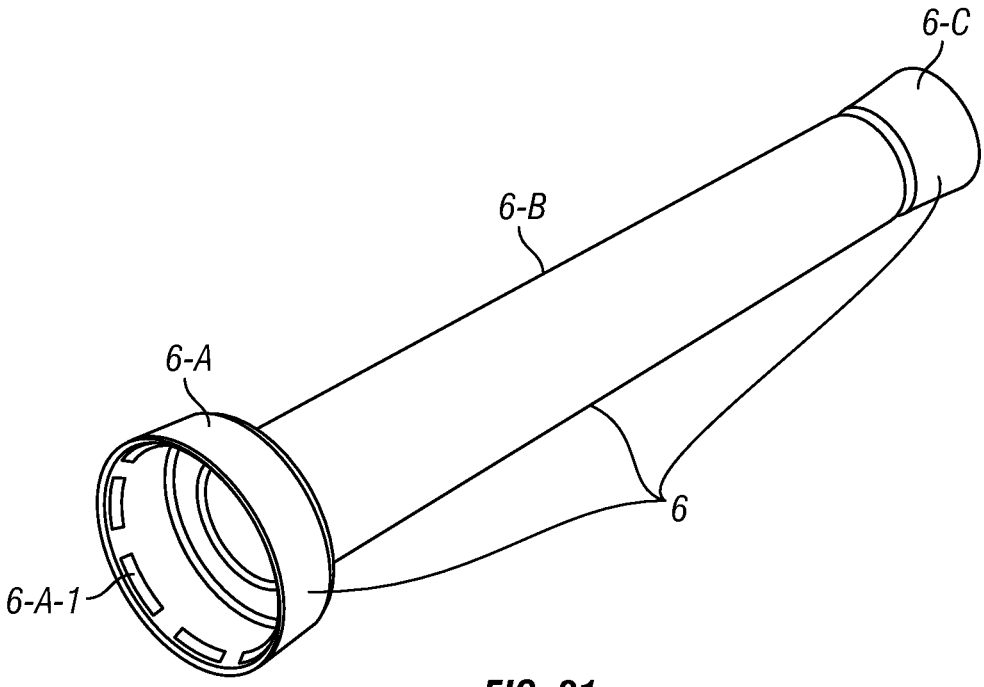
FIG. 21 shows the front perspective of the alternative of the fitting cap, one of the individual components of the set of components of this invention.
Figure 22:
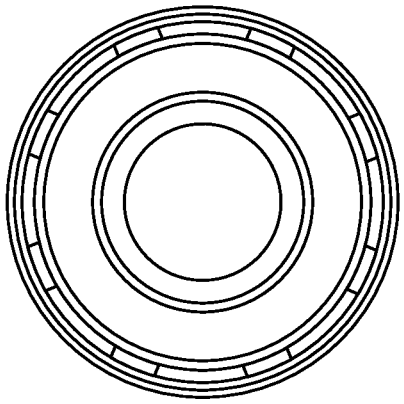
FIG. 22 shows the front view from (6-A-1) to (6-C) of the alternative of the fitting cap, one of the individual components of the set of components of this invention.
Figure 23:
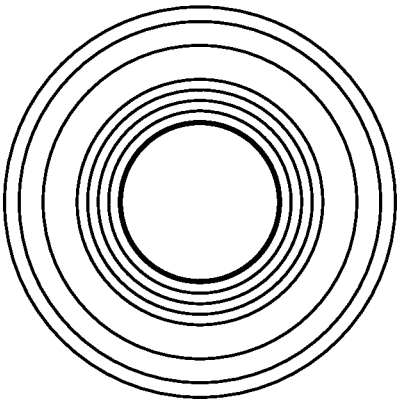
FIG. 23 shows the rear view from (6-C) to (6-A-1) of the alternative of the fitting cap, one of the individual components of the set of components of this invention.

Alternatively one could adopt the fitting cap (6) in plastic or other suitable material with elongated shape, with truncated-cone-shaped anterior sleeve (6-A) and with click type male fitting bounce (6-A-1) (for a perfect fit into the groove (2-A-1) of the anchor plate (2)), cylindrical-shaped central body (6-B) and truncated-cone-shaped posterior end (6-C). See FIGS. 21, 22 and 23.

Figure 24:
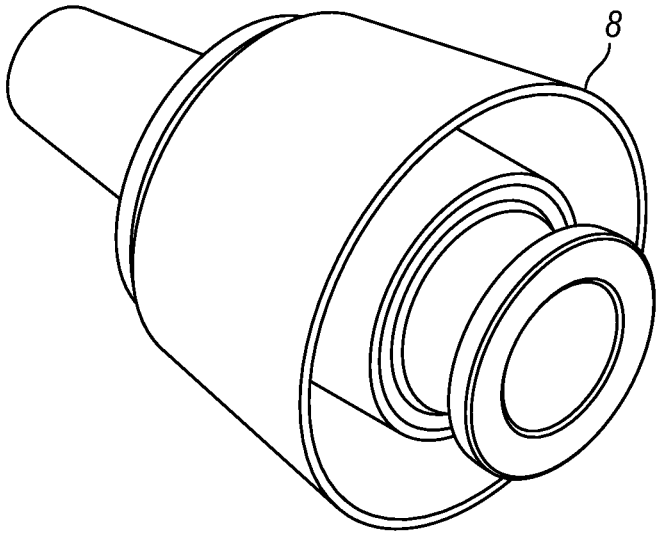
FIG. 24 shows the front view of the monobloc pocket form (assembled), one of the individual components of the set of components of this invention.

Alternatively, one could adopt the pocket form monoblock (8) in plastic or other suitable material of the same mountable pocket form constructiveness (4), but with single monoblock body. See FIG. 24.

Figure 25:
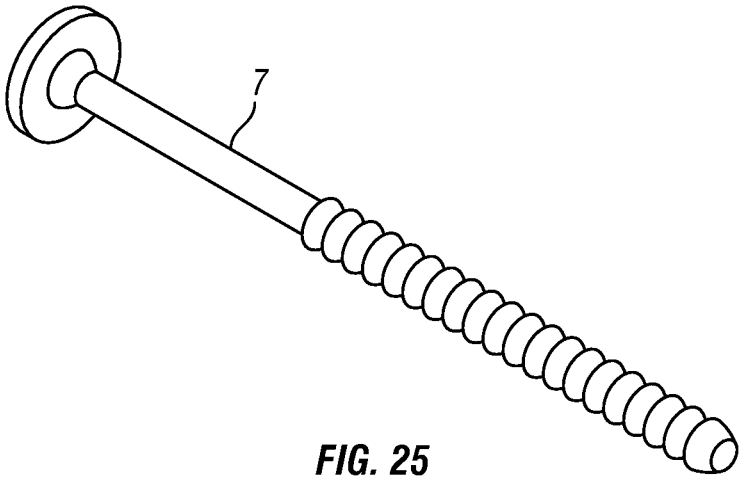
FIG. 25 shows the front perspective of the pull rod alternative, one of the individual components of the set of components of this invention.
Figure 26:
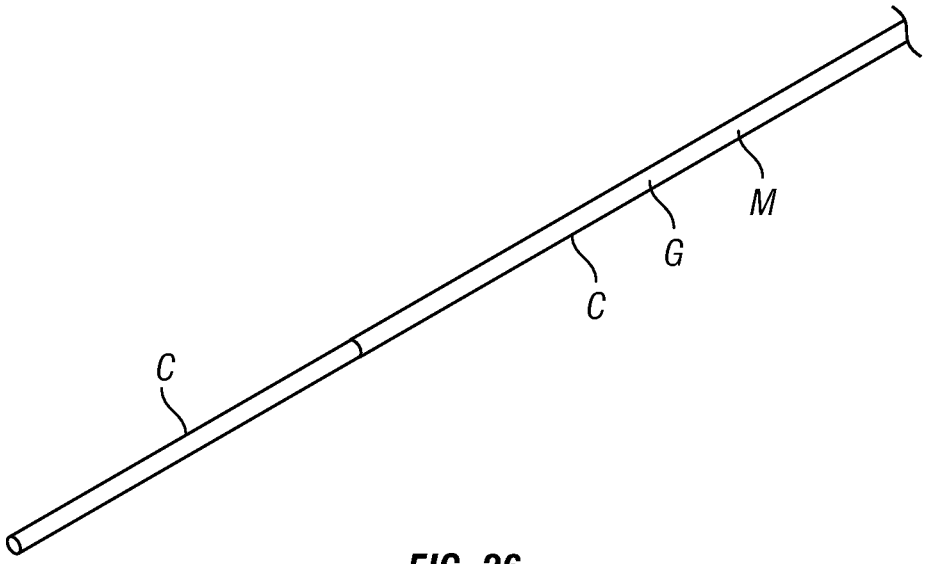
FIG. 26 shows the perspective view of the hose-covered grease tendon of this invention positioned before concreting.
Figure 27:
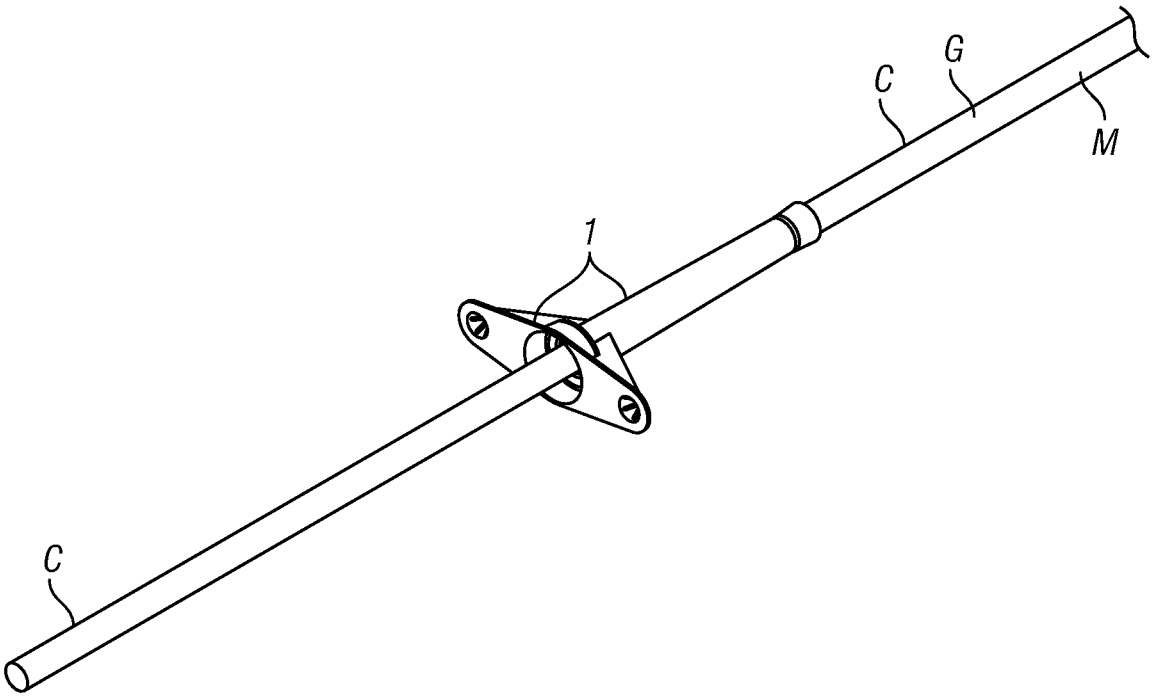
FIG. 27 shows the perspective view of the hose-covered grease tendon and cap of this invention positioned before concreting.
Figure 28:
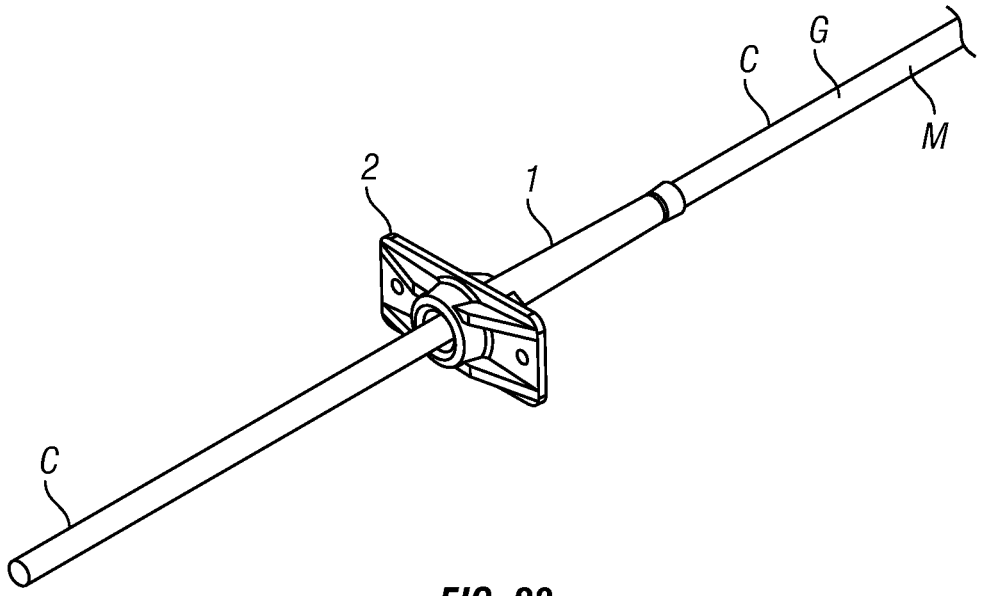
FIG. 28 shows the perspective view of the hose-covered grease tendon with cap and with an anchor plate of this invention positioned before concreting.
Figure 29:
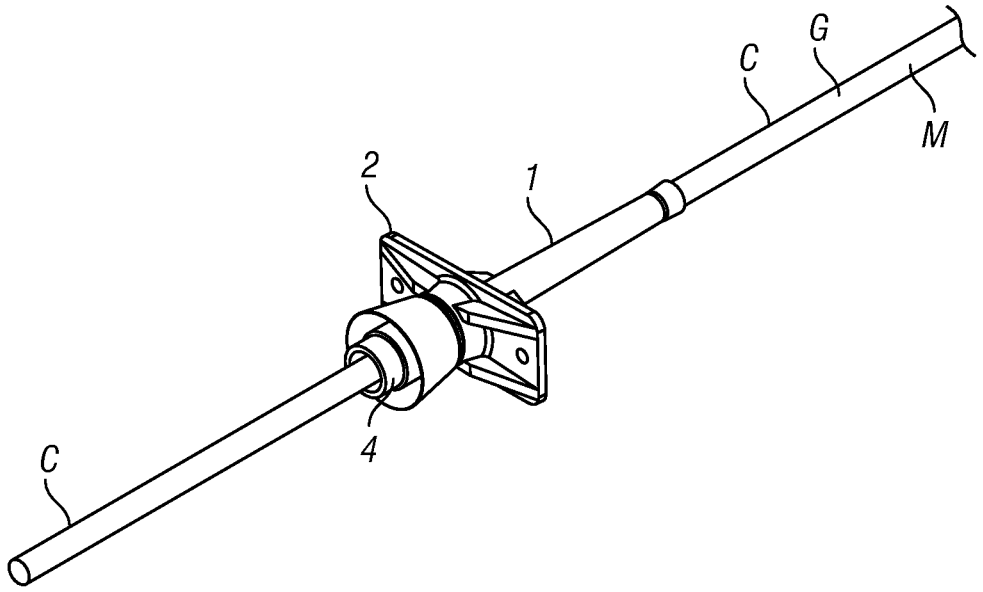
FIG. 29 shows the perspective view of the hose-covered grease tendon with cap, with anchor plate and with the pocket form of this invention positioned before concreting.
Figure 30:
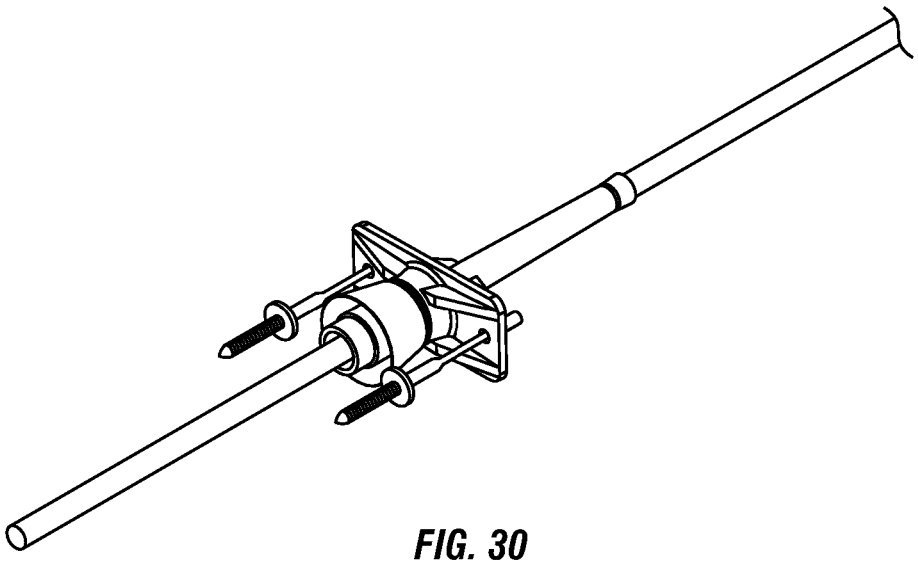
FIG. 30 shows the perspective view of the hose-covered grease tendon with cap, with anchor plate, with pull rods and with the pocket form of this invention.
Figure 31:
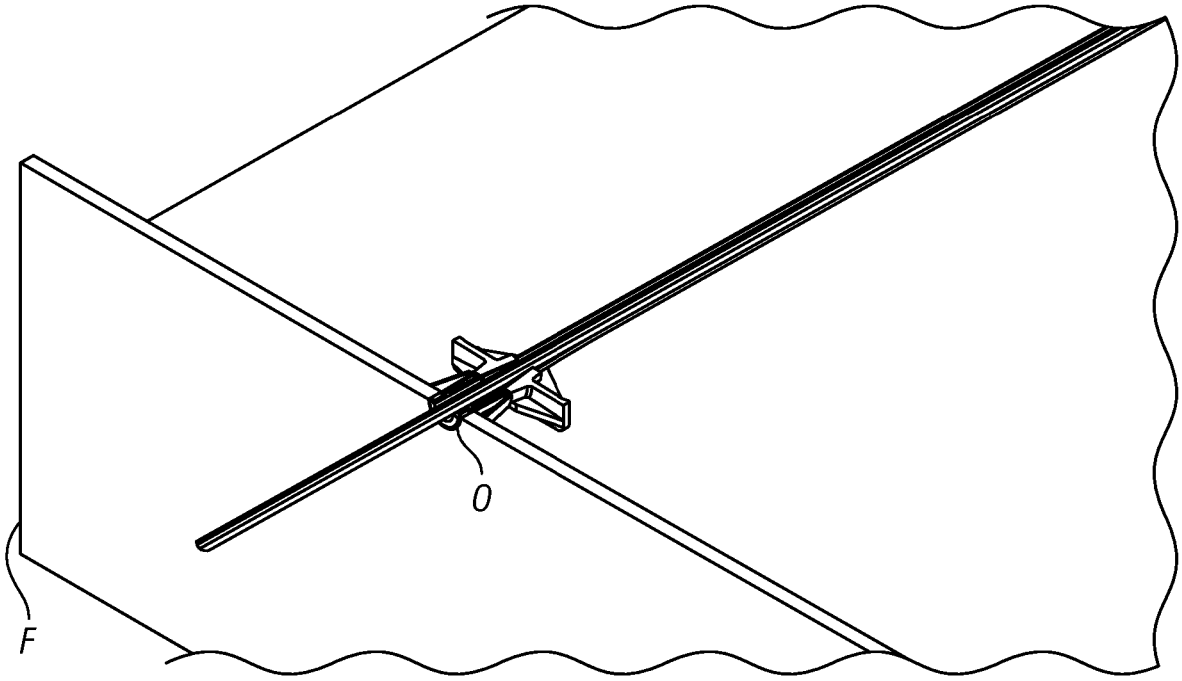
FIG. 31 shows the perspective of the hose-covered grease tendon with cap, with anchor plate, with pocket form and with the form placed before concreting.
Figure 32:
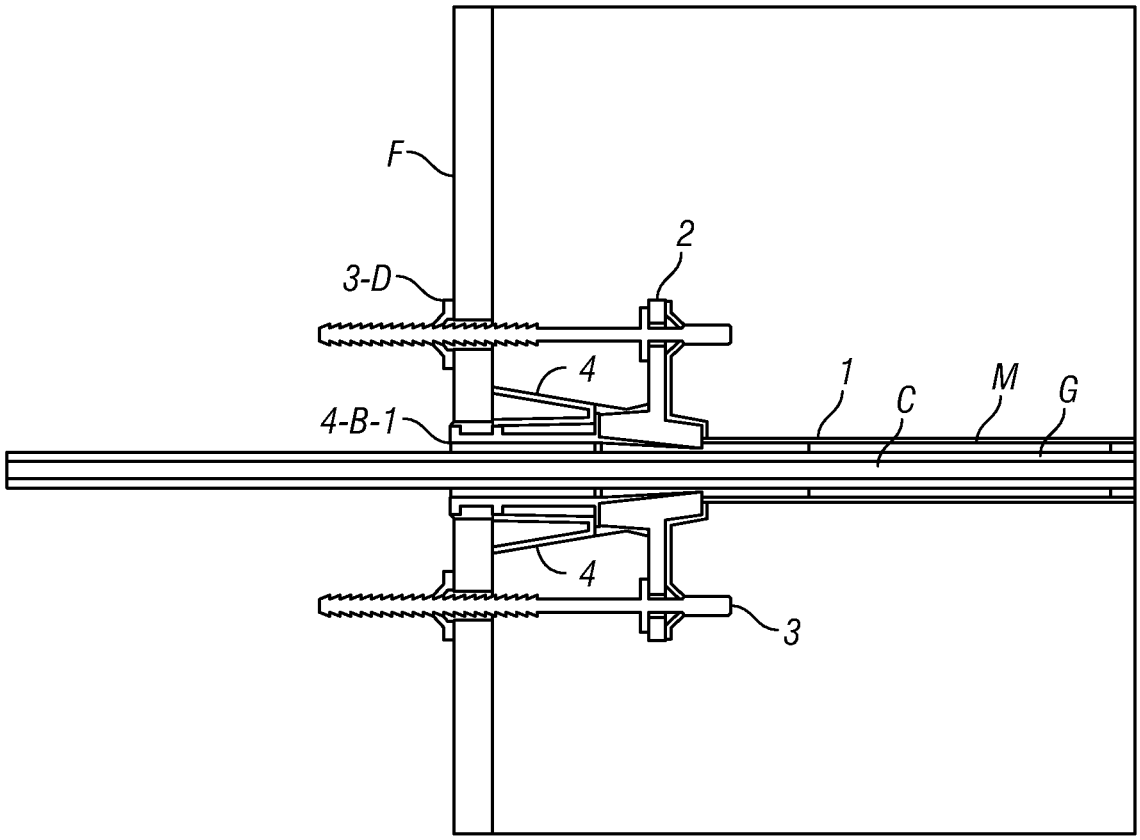
FIG. 32 shows the top view of the hose-covered grease tendon with cap, with anchor plate, with pull rods with pocket form and with the form of this invention placed after the concreting and before deforming.
Figure 33:
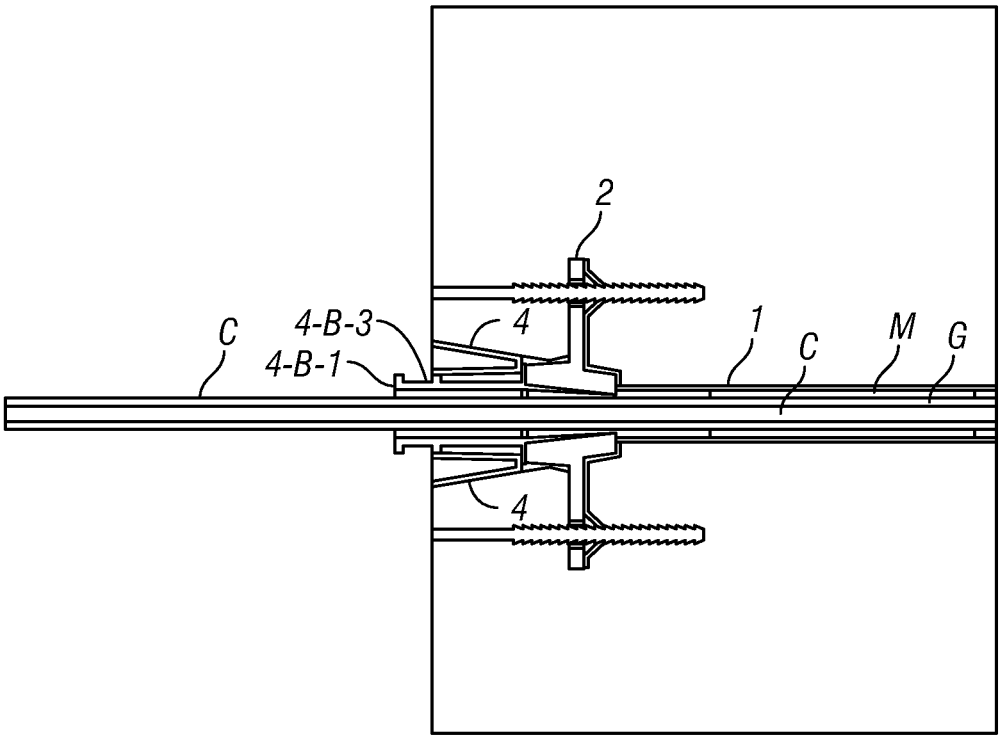
FIG. 33 shows the top view of the hose-covered grease tendon with cap, with anchor plate and with the pull rods with pocket form of this invention placed after the concreting and with the form removed (deformed)
Figure 34:
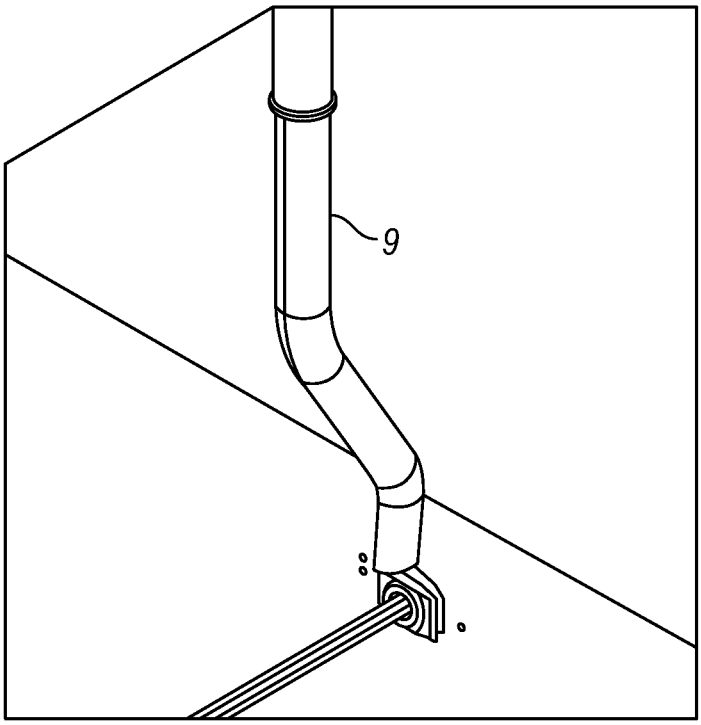
FIG. 34 shows the perspective view of the removal tool of this invention during the removal operation of the pocket form.
Figure 35:
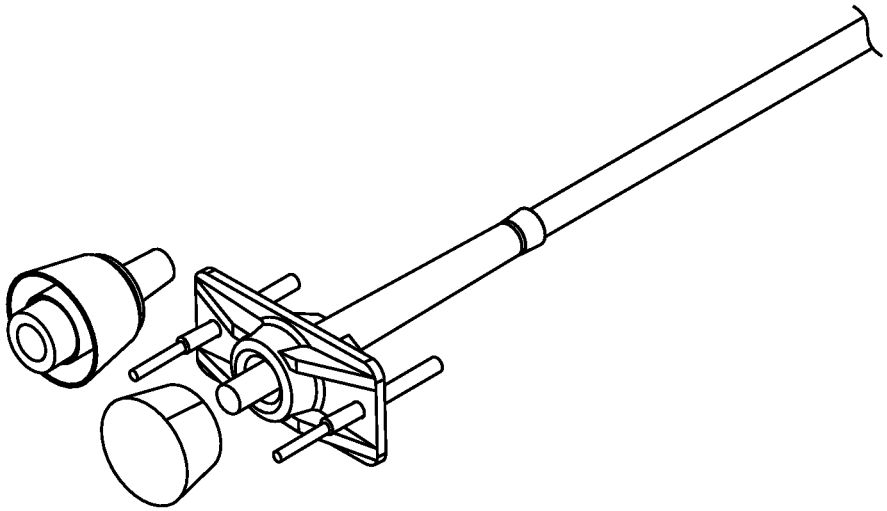
FIG. 35 shows the perspective view of the hose-covered grease tendon with cap, with anchor plate, with cut pull rods, with pocket form removed and with the tendon of this invention.
Figure 36:
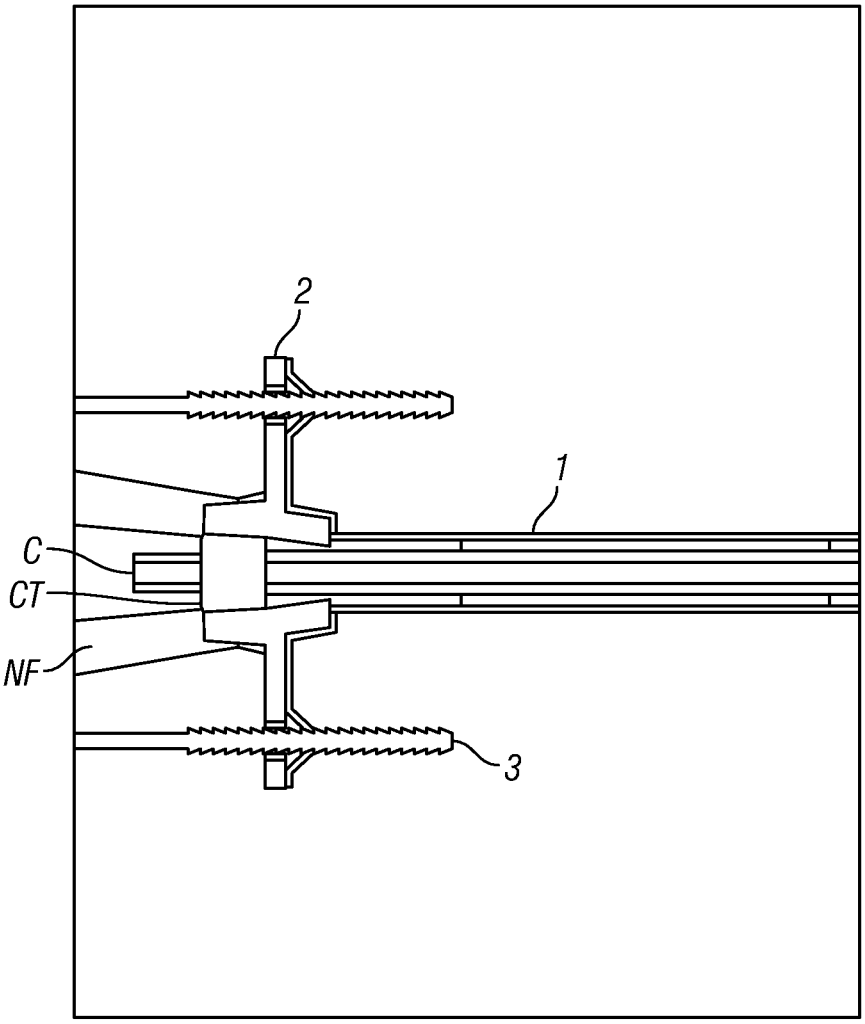
FIG. 36 shows the top view of the hose-covered grease tendon with cap, with anchor plate, with cut pull rods, with pocket form removed, with anchor niche formed, with locking wedge and cut tendon from this invention placed after the concreting and release of the calculating engineer.
Figure 37:
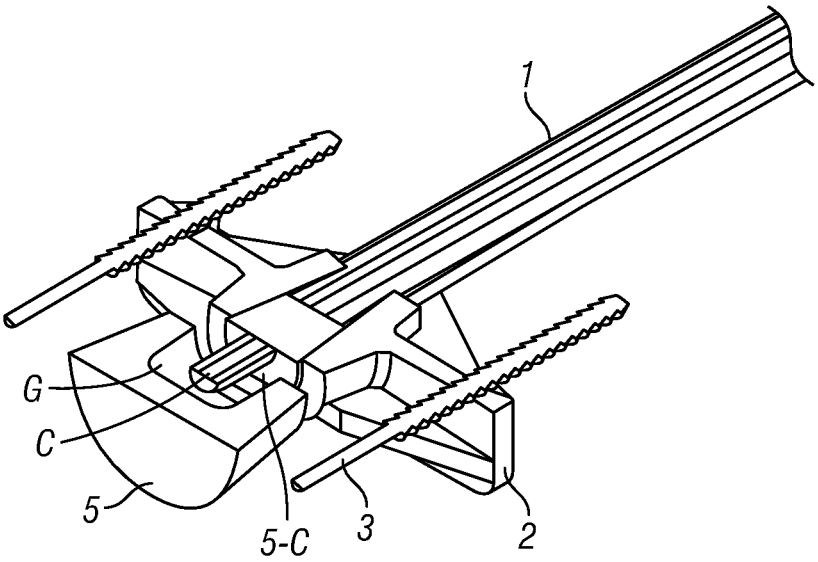
FIG. 37 shows the perspective view of the hose-covered grease tendon with cap, with anchor plate, with cut pull rods, with locking wedge, with cut tendon and with the plug of this invention.
Figure 38:
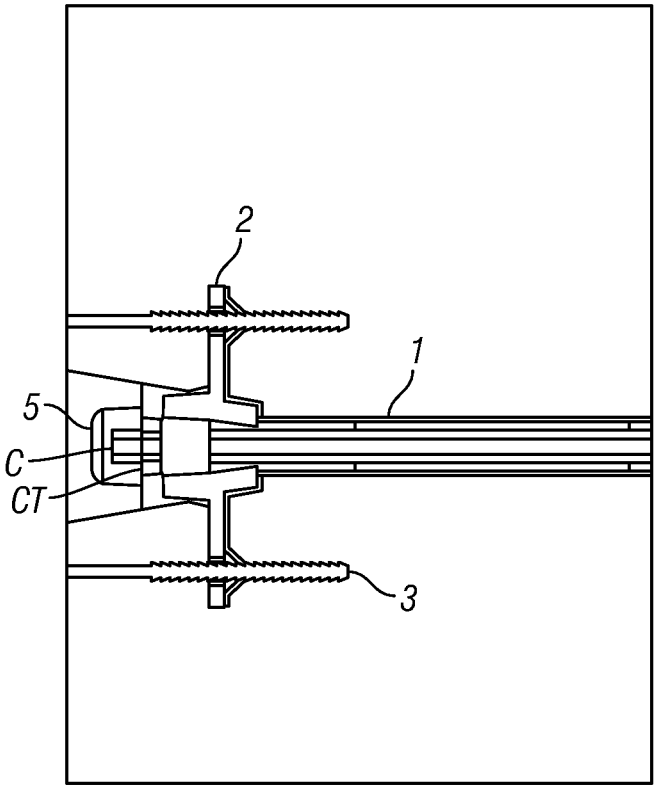
FIG. 38 shows the top view of the hose-covered grease tendon with cap, with anchor plate, with cut pull rods, with formed niche, with locking wedge, with cut tendon and with the plug adhered in the niche of this invention placed after the concreting.
Figure 39:
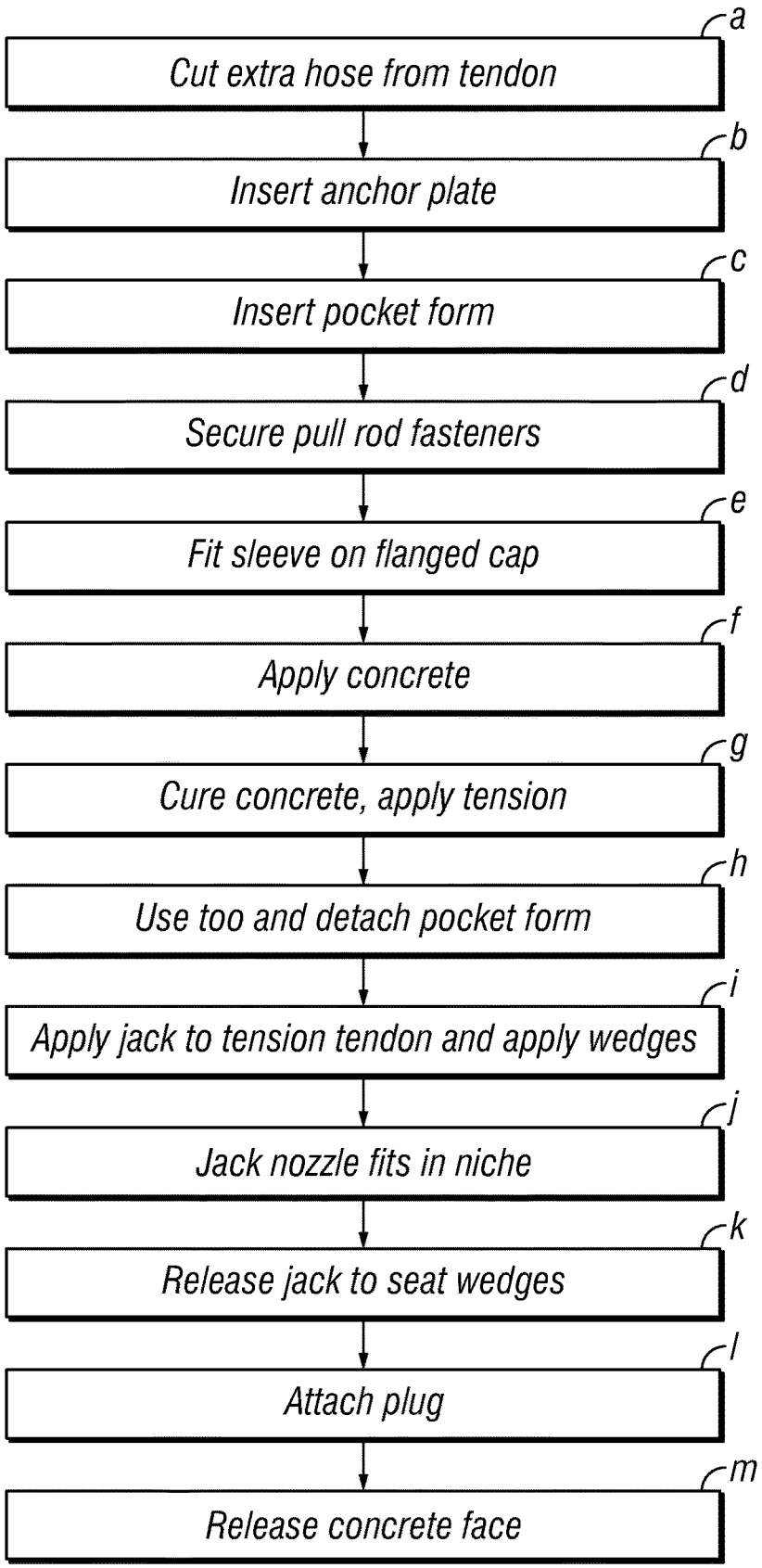
FIG. 39 shows the block diagram of the novel encapsulation process sequence of this invention.

Alternatively, one could adopt a simple head tapping screw type pull rod fastener (7) in plastic or other suitable material with the use of the flanged cap (1) or with the fitting cap (6), as long as it's with the aid of the lock (3-D). See FIG. 25.

Alternatively, the conventional anchor plate, without bouncing for click, can be used in this invention system by fixing the flanged cap (1) using the pull rod fasteners (3) or (7), getting the same quality as the encapsulation process with the components here claimed.

Additionally, the tool (9) has an offset shaft lever shape and tubular cross-section, with handle at the top part, two long radius curves at the intermediate part and a "U"-shaped ear at the bottom part.

It is not recommended the adoption of the components here claimed with conventional pocket form and/or conventional cap by the possibility of entry of concrete cream into the encapsulation process.

The novel encapsulation process of this invention is given in the following sequence:

a) After the release of the tendon (C) covered with a hose (M) the exceeding hose (M) is cut from the tendon (C), grease (G) and hose (M) and install first the flanged cap (1) by moving it up next to the point that will be fixed, with the posterior end (1-C) facing the opposite side of the tensioning point;

b) Insert the anchor plate chosen between the anchor plate (2) and the conventional one:

c) Insert the pocket form chosen between the mountable (4) or the pocket form (8) monoblock with the removing ring (4-B-1) facing the hole (O) of the form (F) to the tensioning point;

d) Pass the tip of the tendon in the hole (O) of the form (F) (which is the space intended to secure the anchor plate (2)) and secure the pull rod fasteners (3) manually or by means of their own tool on the anchor plate connected with pocket form, in the design angle, in the form;

e) Fit the anterior sleeve (1-A) of flanged cap (1) on the posterior bounce (2-A) of the anchor plate (2) with the fixing tabs fastened to the anchor plate (thus ensuring a good seal to prevent the entry of concrete cream and also its possible movement during concreting);

f) After making sure that everything is properly secured and fitted, the concreting of the element to be used in accordance with technical norms and engineering determinations begins;

g) Once the curing time has elapsed and the concrete strength has been reached as established by the Structural Calculus Designer, the tensioning face deformation of the concrete begins;

h) Without the forms, all the pocket form appear in position, ready to begin their removal, which are ergonomically and securely removed with the removing tool (9) with the contributor standing and turned to the same direction as the pocket form, pulling it back, usually in the continuity of the slab, until detachment of the pocket form occurs, positioning the removal end of the tool on the removing ring of the pocket form, penetrating the bounce at the opening of the tool itself with a little effort downwards and then effecting the pulling, which will culminate in total detachment of the pocket form without damaging or ruining it, allowing later manual removal of the piece (and, if necessary, its next reuse) and releasing the anchor niche (NF) formed;

i) With the release of the anchor niche (NF) it is possible to fit the hydraulic jack (MH) and locking wedges (CT) (which will ensure entrapment of the tendon (C) together with the tensioning energy required to keep the prestressed concrete element stressed, generally zeroing out the efforts of the own tensile stresses on concrete);

j) With the anchor niche (NF) without deformations (thanks to the design that minimizes deformations of the pocket form), the hydraulic jack nozzle fits perfectly in this niche;

k) Approved by the estimating engineer, the stress/strain of the tendon (C) and its energy trapped by the locking wedges (CT) through the anchor plate, the excess cut of the tendon (C) is released with appropriate cutter and maintained the end of the tendon (C) exposed with a short distance from the anchor plate ready to receive treatment (and avoid pathology, as this is the most delicate point of the entire length of the tendon and must take care and attention necessary to avoid corrosion and the tendon to come off the anchor plate);

l) With the aid of the handle (5-C), the plug (5) is applied with the grease trapped and the seal (5-B) adhered into the sealant adhesive solution (epoxy, polyurethane or other suitable adhesive available on the market) and then the plug (5) is directed to the anchor niche (NF), cleaned and its ready to receive it, applying it until its full penetration, causing the end of the tendon (C) to break the seal (5-B) so that the grease occupies the empty space and allows the adhesive to squeeze between the plug (5) and the concrete of the anchor niche of the prestressed concrete element; and m) Release the face of the concrete, already prestressed and properly protected, for subsequent finishing application, as specified in architectural design.

The components of the set of components in this invention may be applicable individually or together in currently existing processes.

The encapsulation process of this invention may use only part of the set of components claimed herein associated with conventional components.

The invention claimed is:

1. A set of components for a tendon encapsulation system, comprising:

a flanged cap (1) having elongated shape, an anterior sleeve with truncated-cone shaped fixing tabs (1-A), a cylindrical shaped central body (1-B) and a truncated-cone shaped posterior end (1-C) fittable to an anchor plate (2), the flanged cap secured to the anchor plate by plastic double pull rod fasteners (3) and fittable to a tendon (C), the system comprising a hose (M), the anchor plate (2) having a taper-shaped posterior sleeve (2-A) with a female plug (2-A-1), and fittable to the flanged cap (1) by a mountable pocket form (4);

a front of the double pull rod fasteners (3) having cylindrical shape, locking rings (3-A) and a fixed washer (3-B) and a back of the fasteners with locking rings (3-C) each with a lock (3-D) of ringed and truncated-cone shape with cuts forming locking wedges;

the mountable pocket form (4) comprising two pluggable parts, a truncated-cone shaped hollow outer cover (4-A) with trapezoidal shaped internal guides (4-A-1) and a ring shaped leveling stopper (4-A-2) with sealing skirt (4-A-2-A) having cylindrical and conical shape and a core (4-B) having a hollow cylindrical shape with a removing ring (4-B-1), support ring (4-B-2) having the shape of a ring and a fitting bounce (4-B-3) also in the shape of ring and fittable on the anchor plate (2) and passing through the form (F); and a plug (5) made from concrete or mortar, having truncated-cone shape, closed on one side and with a sealing seal (5-B) adhered and closing the one side, fittable and adhered to an anchor niche (NF).

2. The set of components according to claim 1, wherein the plug (5) comprises a handle (5-C), having shape of an "A", fixed in the other side.

3. The set of components according to claim 1, wherein the flanged cap comprises a fittable cap (6) having elongated shape with a truncated-cone-shaped anterior sleeve (6-A) and with a click type male fitting bounce (6-A-1), cylindrical-shaped central body (6-B) and a truncated-cone-shaped posterior end (6-C).

4. The set of components according to claim 1, wherein the pull rod fasteners comprise simple head tapping screw type pull rod fastener (7) complemented by a lock (3-D).

5. The set of components according to claim 1, wherein the pocket form comprises a monoblock pocket form (8).

6. The set of components according to claim 1 further comprising a pocket form removal tool (9) having an offset shaft lever shape, with a handle at a top part, two curves at an intermediate part and a "U"-shaped ear at a bottom part.

7. The set of components according to claim 1 wherein the plug (5) is filled with antioxidant grease (5-A).

8. A process for encapsulating an anchored tendon using the set of components of claim 1, comprising:

removing excess of the hose from the tendon;

installing the flanged cap having a posterior end onto the tendon proximate a position of the anchor plate;

installing the anchor plate onto the tendon;

installing a form onto the anchor plate using the plastic double pull rod fasteners;

installing a sealing cap and the pocket form onto the anchor plate;

pouring and curing concrete;

removing the pocket form using a tool comprising an offset shaft lever shape, with a handle at a top part, two curves at an intermediate part and a "U"-shaped ear at a bottom part;

tensioning the tendon and locking the tensioned tendon in the anchor plate with locking wedges;

cutting the locked tendon; and installing the plug made from concrete or mortar, having the truncated-cone shape, closed on one side and filled with antioxidant grease, with a sealing seal adhered and closing an anchor niche made by the pocket form in the concrete.

* * * * *